US009360877B2

(12) United States Patent
Kwon

(10) Patent No.: US 9,360,877 B2
(45) Date of Patent: Jun. 7, 2016

(54) NEGATIVE VOLTAGE REGULATION CIRCUIT AND VOLTAGE GENERATION CIRCUIT INCLUDING THE SAME

(71) Applicant: SK hynix Inc., Gyeonggi-do (KR)

(72) Inventor: Jae-Kwan Kwon, Gyeonggi-do (KR)

(73) Assignee: SK Hynix Inc., Gyeonggi-do (KR)

( * ) Notice: Subject to any disclaimer, the term of this patent is extended or adjusted under 35 U.S.C. 154(b) by 182 days.

(21) Appl. No.: 14/328,294

(22) Filed: Jul. 10, 2014

(65) Prior Publication Data

US 2014/0320097 A1 Oct. 30, 2014

Related U.S. Application Data

(62) Division of application No. 13/830,744, filed on Mar. 14, 2013, now Pat. No. 8,810,306.

(30) Foreign Application Priority Data

Dec. 14, 2012 (KR) ..... 10-2012-0146373

(51) Int. Cl.

| | |
|---|---|
| ***G05F 1/46*** | (2006.01) |
| ***G05F 1/575*** | (2006.01) |
| ***G05F 5/00*** | (2006.01) |
| ***G05F 1/613*** | (2006.01) |

(52) U.S. Cl.

CPC ..... *G05F 1/575* (2013.01); *G05F 1/613* (2013.01); *G05F 5/00* (2013.01)

(58) Field of Classification Search

CPC ..... G05F 1/10; G05F 1/4654; G05F 1/462; G05F 1/463; G05F 1/464; G05F 1/613; G05F 1/575; G05F 5/00

See application file for complete search history.

(56) References Cited

U.S. PATENT DOCUMENTS

| | | | | |
|---|---|---|---|---|
| 4,727,309 | A * | 2/1988 | Vajdic | G05F 3/247 323/312 |
| 5,434,533 | A * | 7/1995 | Furutani | G05F 1/463 323/313 |
| 5,787,037 | A * | 7/1998 | Amanai | G11C 16/30 365/185.18 |
| 5,825,238 | A * | 10/1998 | Poimboeuf | H03H 11/126 327/532 |
| 6,882,213 | B2 * | 4/2005 | Kim | G01K 7/01 327/138 |
| 7,042,274 | B2 * | 5/2006 | Hazucha | G05F 1/46 323/274 |
| 7,145,318 | B1 * | 12/2006 | Chan | G05F 1/465 323/280 |
| 7,400,124 | B2 * | 7/2008 | Schreck | G05F 1/46 323/282 |
| 7,863,968 | B1 * | 1/2011 | Perisetty | G05F 1/56 327/537 |
| 7,944,663 | B2 * | 5/2011 | Morino | G05F 1/573 323/274 |
| 2004/0004992 | A1 * | 1/2004 | Aota | G01K 7/01 374/163 |
| 2005/0270011 | A1 * | 12/2005 | Aota | G01K 7/01 323/315 |
| 2005/0275375 | A1 * | 12/2005 | Liu | H02J 7/0052 320/128 |
| 2006/0203550 | A1 * | 9/2006 | Lee | G11C 16/30 365/185.13 |
| 2009/0201067 | A1 * | 8/2009 | Haneda | G05F 3/30 327/306 |

(Continued)

*Primary Examiner* — Timothy J Dole
*Assistant Examiner* — Yusef Ahmed
(74) *Attorney, Agent, or Firm* — IP & T Group LLP

(57) ABSTRACT

A negative voltage regulation circuit includes an operational amplifier configured to receive a feedback voltage and an input voltage, a pull-up element configured to pull-up drive a first node based on output voltage of the operational amplifier, a load element coupled between the first node and a negative voltage terminal, a pull-down element configured to pull-down drive a final negative voltage output terminal using a voltage of the negative voltage terminal based on a voltage level of the first node, and a voltage division unit coupled between the final negative voltage output terminal and a pull-up voltage terminal, and configured to generate the feedback voltage by voltage division.

9 Claims, 4 Drawing Sheets

(56) References Cited

U.S. PATENT DOCUMENTS

2009/0323438 A1* 12/2009 Choi ..... G11C 8/08 365/189.09
2010/0102794 A1* 4/2010 Erbito, Jr. ..... G05F 3/30 323/313
2012/0013396 A1* 1/2012 Morino ..... G05F 3/24 327/540
2013/0221942 A1* 8/2013 Hu ..... H03F 3/45183 323/282
2013/0258543 A1* 10/2013 Suzuki ..... H01T 23/00 361/231
2014/0167839 A1* 6/2014 Kwon ..... G05F 1/613 327/543
2014/0313840 A1* 10/2014 Hwang ..... G11C 29/785 365/200
2014/0340067 A1* 11/2014 Zhong ..... G05F 3/08 323/311
2015/0002131 A1* 1/2015 Takada ..... H03F 3/345 323/313
2015/0042297 A1* 2/2015 Hu ..... G05F 1/56 323/271
2015/0355665 A1* 12/2015 Maeda ..... G05F 3/262 327/543

* cited by examiner

NEGATIVE VOLTAGE REGULATION CIRCUIT AND VOLTAGE GENERATION CIRCUIT INCLUDING THE SAME

CROSS-REFERENCE TO RELATED APPLICATIONS

This application is a division of U.S. patent application Ser. No. 13/830,744 filed on Mar. 14, 2013, which claims priority of Korean Patent Application No. 10-2012-0146373, filed on Dec. 14, 2012. The disclosure of each of the foregoing application is incorporated herein by reference in its entirety.

BACKGROUND

1. Field

Exemplary embodiments of the present invention relate to semiconductor design technology, and more particularly, to a negative voltage regulation circuit and a voltage generation circuit including the same.

2. Description of the Related Art

Semiconductor devices operate internal circuits thereof using external voltages supplied from the external source. However, since various levels of voltages are used in a semiconductor device, it may be difficult to supply all of the voltages to be used in the semiconductor device from the external source. In this regard, a semiconductor device includes voltage generation circuits for generating voltages with various levels using the external voltages.

FIG. 1 is a block diagram illustrating a conventional voltage generation circuit for generating a read voltage supplied to a word line in a read operation in a nonvolatile memory device such as a flash memory.

Referring to FIG. 1, the voltage generation circuit includes a first correction unit 110, a second correction unit 120, a target value provision unit 130, and an adding unit 140.

The first correction unit 110 generates a voltage X for regulating the level of the read voltage VREAD which is a final output voltage of the voltage generation circuit, based on a process skew variation. That is, the level of the voltage X is changed based on the process skew variation.

The second correction unit 120 for correcting a temperature variation generates a voltage Y based on the voltage X and temperature information (not illustrated) outputted from a temperature sensor (not illustrated). That is, the level of the voltage Y is changed based on the level of the voltage X and the temperature information. Thus, the voltage Y includes information on the amount of the read voltage VREAD to be regulated based on the process skew variation and the temperature variation.

The target value provision unit 130 generates a voltage Z having information on a target voltage of the read voltage VREAD. The target voltage indicates a voltage level of the read voltage VREAD in a state in which the process skew variation and the temperature variation are normal. For example, when the target voltage is 2V, the read voltage VREAD becomes $2\pm\alpha$V based on the process skew variation and the temperature variation ($\alpha$ is a correction value corresponding to the process skew variation and the temperature variation). When the target voltage is 3V, the read voltage VREAD becomes $3\pm\alpha$V based on the process skew variation and the temperature variation.

The adding unit 140 linearly adds the voltage Y and the voltage Z to generate the read voltage VREAD. Since the voltage Y includes information on a correction value of the read voltage VREAD based on the temperature variation and the process skew variation and the voltage Z includes information on the target voltage of the read voltage VREAD, the read voltage VREAD generated by linearly adding the voltage Y and the voltage Z has a value of 'target voltage$\pm\alpha$'.

In the conventional art, only a positive voltage is used as the read voltage VREAD. Recently, a negative voltage is also used as the read voltage to secure cell Vt distribution. However, it may be difficult to design the adding unit 140 that adds a negative voltage (e.g., the target voltage) and a positive voltage (e.g., the correction value of the target voltage) or adds two negative voltages. Since the adding unit 140 uses the negative voltage as a driving voltage even when implemented, a large amount of current may be consumed. In this regard, a voltage generation circuit that may regulate the level of a negative voltage by positive voltages while providing the negative voltage as a final output voltage is in demand.

SUMMARY

Exemplary embodiments of the present invention are directed to a negative voltage regulation circuit that may regulate the level of a negative voltage based on a positive voltage.

Other embodiments of the present invention are directed to a voltage generation circuit that may generate various types of trimming information, such as process skew variation or temperature variation, as a positive voltage, and may generate a negative voltage having a level varying by the positive voltage including the trimming information.

In accordance with an embodiment of the present invention, a negative voltage regulation circuit includes an operational amplifier configured to receive a feedback voltage and an input voltage, a pull-up element configured to pull-up drive a first node based on output voltage of the operational amplifier, a load element coupled between the first node and a negative voltage terminal, a pull-down element configured to pull-down drive a final negative voltage output terminal using a voltage of the negative voltage terminal, based on a voltage level of the first node, and a voltage division unit coupled between the output terminal and a pull-up voltage terminal, and configured to generate the feedback voltage by voltage division.

In accordance with another embodiment of the present invention, a voltage generation circuit includes a negative voltage generation unit configured to generate a negative voltage, a first voltage generation unit configured to generate a first positive voltage having first correction information, a second voltage generation unit configured to generate a second positive voltage having second correction information, an addition unit configured to add the first positive voltage and the second positive voltage to generate a third positive voltage, and a negative voltage regulation unit configured to regulate the negative voltage based on the third positive voltage and regulation target information, and to generate a final negative voltage.

In accordance with yet another embodiment of the present invention, a negative voltage regulation circuit includes an operational amplifier configured to receive a feedback voltage and an input voltage, a first PMOS transistor having a source coupled to a power supply voltage terminal, a drain coupled to a first node, and a gate receiving an output voltage of the operational amplifier, a first resistor coupled between the first node and a negative voltage terminal, a voltage division unit coupled between the power supply voltage terminal and a final output terminal, and configured to output the feedback voltage by using a voltage division ratio, which is varied based on regulation target information, and a second PMOS transistor having a source coupled to the final output terminal, a drain coupled to the negative voltage terminal, and a gate coupled to the first node.

The negative voltage regulation circuit in accordance with an embodiment of the present invention may regulate the level of a negative voltage based on a positive voltage with a simple circuit configuration.

The voltage generation circuit in accordance with another embodiment of the present invention may generate various types of trimming information, such as process skew variation or temperature variation, as a positive voltage, and may generate a negative voltage having a level varying based on the positive voltage including the trimming information.

DETAILED DESCRIPTION

Figure 1:
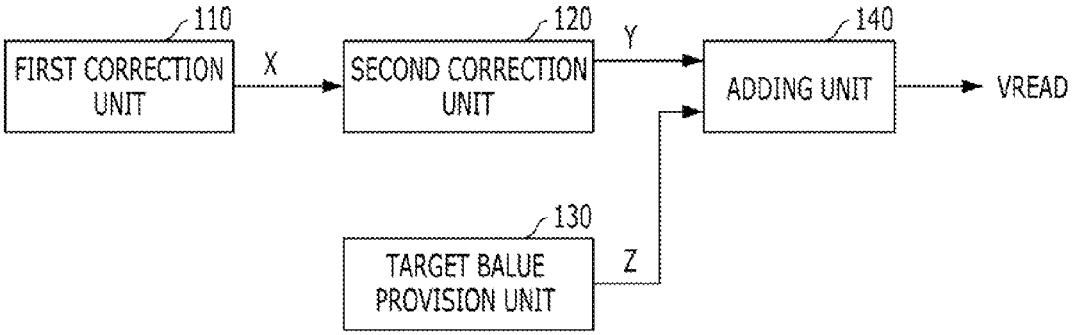
FIG. 1 (PRIOR ART)
FIG. 1 is a block diagram illustrating a conventional voltage generation circuit for generating a read voltage.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, reference numerals correspond directly to the like parts in the various figures and embodiments of the present invention. It is also noted that in this specification, "connected/coupled" refers to one component not only directly coupling another component but also indirectly coupling another component through an intermediate component. In addition, a singular form may include a plural form as long as it is not specifically mentioned in a sentence.

Figure 2:
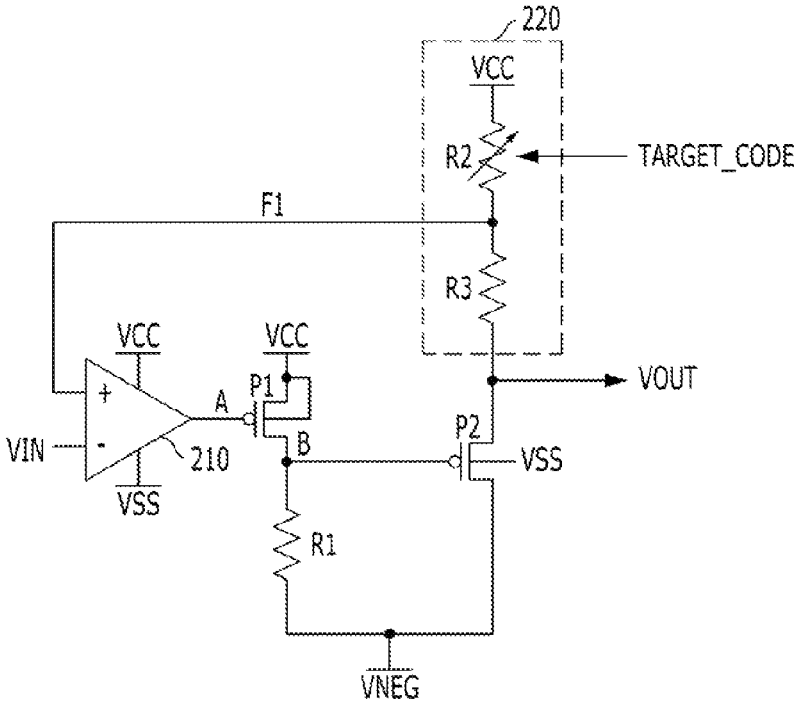
FIG. 2 is a circuit diagram illustrating a negative voltage regulation circuit in accordance with an embodiment of the present invention.

FIG. 2 is a circuit diagram illustrating a negative voltage regulation circuit in accordance with an embodiment of the present invention.

Referring to FIG. 2, the negative voltage regulation circuit includes an operational amplifier 210, a pull-up element P1, a load element R1, a pull-down element P2, and a voltage division unit 220.

The operational amplifier 210 is configured to receive a feedback voltage F1 and an input voltage VIN. The input voltage VIN is used to regulate a voltage level of an output terminal VOUT of the negative voltage regulation circuit. The input voltage VIN and the feedback voltage F1 inputted to the operational amplifier 210 are positive voltages, and the operational amplifier 210 operates using a pull-up voltage and a ground voltage VSS. In the exemplary embodiment, the pull-up voltage is exemplified as a power supply voltage VCC. However, as well as the power supply voltage VCC, a positive voltage having a level lower than the power supply voltage VCC may be used as the pull-up voltage. Output voltage A of the operational amplifier 210 is increased as the feedback voltage F1 becomes higher than the input voltage VIN, and is reduced as the input voltage VIN becomes higher than the feedback voltage F1.

The pull-up element P1 is configured to pull-up drive a node B based on the output voltage A of the operational amplifier 210. The pull-up element P1 may include a PMOS transistor as illustrated in FIG. 2, and a pull-up voltage VCC may be supplied to a body of the PMOS transistor. As the output voltage A of the operational amplifier 210 has a low level, the pull-up element P1 is strongly turned on to increase a voltage of the node B. As the output voltage A of the operational amplifier 210 has a high level, the pull-up element P1 is weakly turned on to reduce the voltage of the node B.

The load element (R1, a resistor) is coupled between the pull-up element P1 and a negative voltage terminal VNEG. The negative voltage terminal VNEG is a voltage terminal to which a negative voltage VNEG to be regulated by the negative voltage regulation circuit is supplied.

The pull-down element P2 is configured to pull-down drive an output terminal VOUT using the negative voltage, which is supplied to the negative voltage terminal VNEG, based on the voltage of the node B. The pull-down element P2 may include a PMOS transistor as illustrated in FIG. 2, and the ground voltage VSS may be supplied to a body of the PMOS transistor. This may substantially prevent a current path from being generated by the turn-on of a parasitic diode generated in the PMOS transistor (refer to FIG. 7). As the voltage of the node B becomes low, the pull-down element is strongly turned on to reduce a voltage level of the output terminal VOUT. As the voltage of the node B becomes high, the pull-down element is weakly turned on to increase the voltage level of the output terminal VOUT.

The voltage division unit 220 is coupled between the output terminal VOUT and a pull-up voltage terminal VCC and is configured to generate the feedback voltage F1 by voltage division. The voltage division unit 220 may include two resistors R2 and R3 as illustrated in FIG. 2, wherein among the two resistors R2 and R3, the resistor R2 may be a variable resistor having a resistance that is adjusted by regulation target information TARGET_CODE. FIG. 2 illustrates that the resistance of the resistor R2 is adjusted by the regulation target information TARGET_CODE. However, a resistance of the resistor R3 may be adjusted by the regulation target information TARGET_CODE. Furthermore, the voltage division unit 220 may be designed to include three or more resistors, wherein among the three or more resistors, a resistance of at least one resistor may be adjusted by the regulation target information TARGET_CODE.

From a different point of view, the PMOS transistor P2 and the voltage division unit 220 may form a source follower.

An entire operation of the negative voltage regulation circuit will be described. When the level of the feedback voltage F1 is higher than that of the input voltage VIN, the voltage of the node B is reduced and thus the voltage of the output terminal VOUT is reduced. Meanwhile, as the level of the input voltage VIN becomes higher than that of the feedback voltage F1, the voltage of the node B is increased, and thus the voltage of the output terminal VOUT is increased. These operations are repeated, so that the level of the feedback voltage F1 is substantially equal to the level of the input voltage VIN. Accordingly, the voltage level VOUT of the output terminal is VIN+(R3/R2)*(VIN−VCC). That is the voltage level of the output terminal VOUT is determined based on a resistance ratio of R3/R2 determined by the regulation target information TARGET_CODE, and the level of the input voltage VIN.

The negative voltage regulation circuit of the embodiment of the present invention is able to regulate the level of the negative voltage VOUT that is outputted by the input voltage VIN having a positive voltage level and the regulation target information TARGET_CODE having a positive voltage level. Furthermore, the negative voltage regulation circuit of the embodiment of the present invention has an advantage in that a negative voltage is supplied only to the negative voltage terminal VNEG and the output terminal VOUT, and a positive voltage is used in other nodes.

Figure 3:
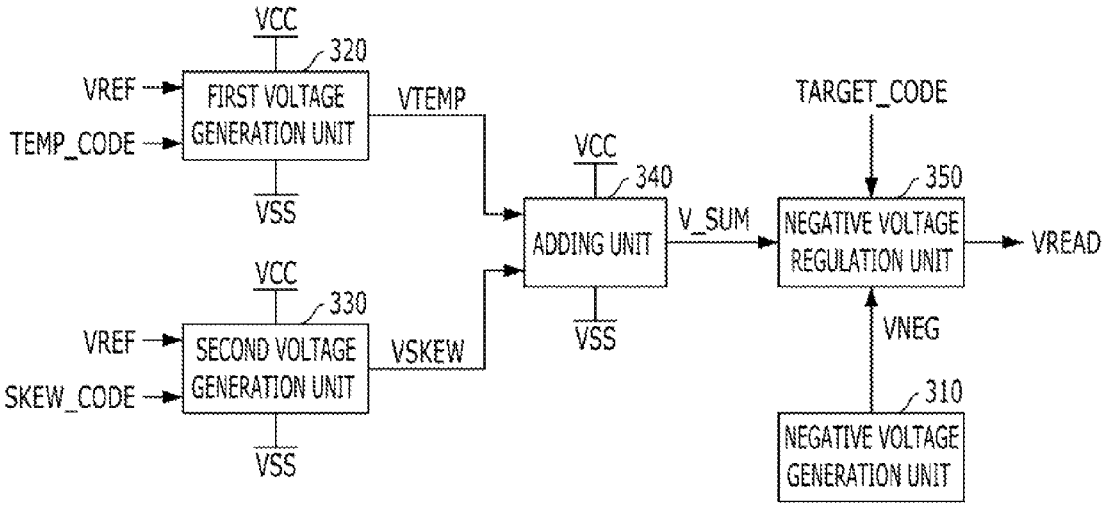
FIG. 3 is a block diagram illustrating a voltage generation circuit in accordance with an embodiment of the present invention.

FIG. 3 is a block diagram illustrating a voltage generation circuit in accordance with another embodiment of the present invention. The voltage generation circuit, which generates a negative read voltage VREAD to be supplied to a word line in a read operation in a nonvolatile memory, is illustrated.

Referring to FIG. 3, the voltage generation circuit includes a negative voltage generation unit 310, a first voltage generation unit 320, a second voltage generation unit 330, an adding unit 340, and a negative voltage regulation unit 350 (FIG. 2).

The negative voltage generation unit 310 is configured to generate a negative voltage VNEG having a negative level that is lower than that of the ground voltage VSS using the power supply voltage VCC and the ground voltage VSS. It is widely known that the negative voltage generation unit 310 may include a plurality of charge pumps serially connected to one another or connected in parallel to one another.

The first voltage generation unit 320 is configured to receive a reference voltage VREF and temperature information TEMP_CODE and to generate a first voltage V_TEMP having a positive level. A level of the first voltage V_TEMP is changed based on a level of the reference voltage VREF and the temperature information TEMP_CODE. As a consequence, the first voltage V_TEMP has information on temperature. The first voltage generation unit 320 uses the power supply voltage VCC and the ground voltage VSS as an operating voltage thereof.

The second voltage generation unit 330 is configured to receive the reference voltage VREF and process skew information SKEW_CODE and to generate a second voltage V_SKEW having a positive level. A level of the second voltage V_SKEW is changed based on the level of the reference voltage VREF and the process skew information SKEW_CODE. As a consequence, the second voltage V_SKEW has information on process skew. The second voltage generation unit 330 uses the power supply voltage VCC and the ground voltage VSS as an operating voltage thereof.

The adding unit 340 is configured to linearly add the first voltage V_TEMP and the second voltage V_SKEW and generate a third voltage V_SUM. Since the first voltage V_TEMP has the information on temperature and the second voltage V_SKEW has the information on process skew, the third voltage V_SUM includes information on the amount by which an output voltage of the voltage generation circuit is to be changed based on environment, such as temperature and process skew. The adding unit 340 uses the power supply voltage VCC and the ground voltage VSS as an operating voltage thereof.

The negative voltage regulation unit 350 indicates the negative voltage regulation circuit described in FIG. 2. In FIG. 2, the terminal VIN corresponds to a terminal V_SUM of FIG. 3 and the terminal VOUT corresponds to a terminal VREAD of FIG. 3. The negative voltage regulation unit 350 generates a read voltage VREAD that is a negative voltage having regulation target information TARGET_CODE on a target voltage of the read voltage VREAD and a level regulated by a voltage level of the third voltage V_SUM.

Referring to FIG. 3, the voltage V_TEMP having the information on temperature and the voltage V_SKEW having the information on process skew are generated as positive voltages, and these positive voltages V_TEMP and V_SKEW are added by the adding unit 340 and are generated as the voltage V_SUM indicating an environmental factor. Then, based on the voltage V_SUM, which is a positive voltage that indicates an environmental factor, and the regulation target information TARGET_CODE, the read voltage VREAD having a negative value is generated. Consequently, a negative voltage may be generated while maximally suppressing the use of a negative voltage.

FIG. 3 illustrates that the voltage generation circuit generates the read voltage VREAD of the memory device. However, the voltage generation circuit of the embodiment of the present invention may be applied to all types of devices as well as the memory device, and may be used to generate various negative voltages. Furthermore, FIG. 3 illustrates that the voltage generation circuit uses the process skew information SKEW_CODE and the temperature information TEMP_CODE as the environmental factor. However, in addition to these types of information, other types of information (for example, information on an operating frequency or information on various setting values) may be used as the environmental factor.

Figure 4:
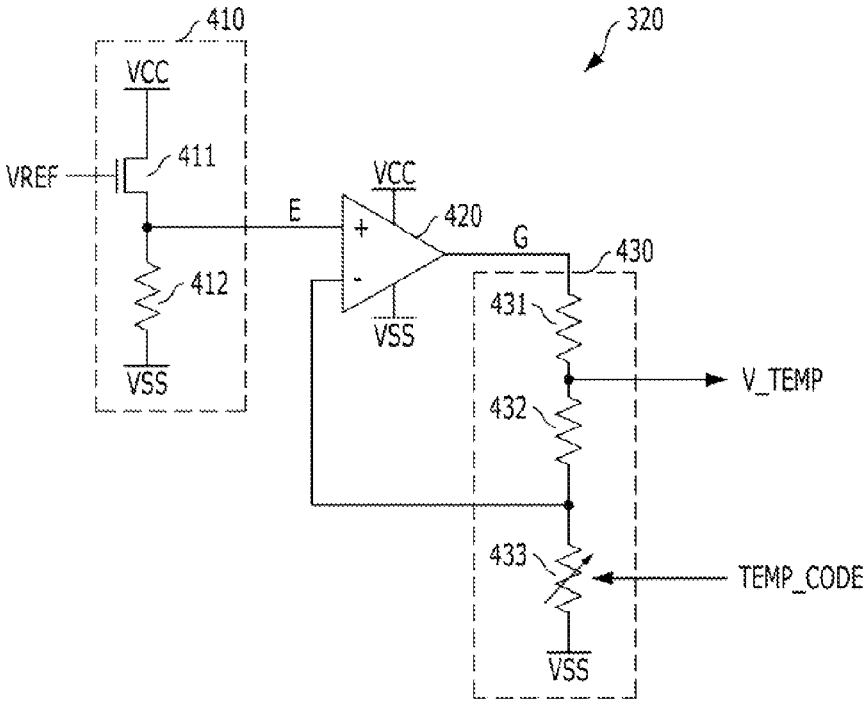
FIG. 4 is a detailed diagram illustrating a first voltage generation unit shown in FIG. 3.

FIG. 4 is a detailed diagram illustrating the first voltage generation unit 320 shown in FIG. 3.

Referring to FIG. 4, the first voltage generation unit 320 includes a control voltage generation section 410, an operational amplifier 420, and a voltage division section 430.

The control voltage generation section 410 includes a transistor 411 and a resistor 412. As the level of the reference voltage VREF inputted to the transistor 411 becomes high, a level of a control voltage E is high, and as the level of the reference voltage VREF becomes low, the level of the control voltage E is low.

The operational amplifier 420 is configured to receive the control voltage E and a feedback voltage F2. When the level of the control voltage E is higher than that of the feedback voltage F2, a voltage level of an output node G of the operational amplifier 420 is high. When the level of the feedback voltage F2 is higher than that of the control voltage E, the voltage level of the output node G of the operational amplifier 420 is low.

The voltage division section 430 is configured to divide the voltage of the output node G of the operational amplifier 420 using resistors 431 to 433, and to generate the first voltage V_TEMP and the feedback voltage F2. Among the resistors 431 to 433, a resistance of the resistor 433 may be adjusted based on the temperature information TEMP_CODE.

The first voltage generation unit 320 having the aforementioned configuration generates the first voltage V_TEMP having a level that is determined based on the level of the reference voltage VREF and the temperature information TEMP_CODE.

Figure 5:
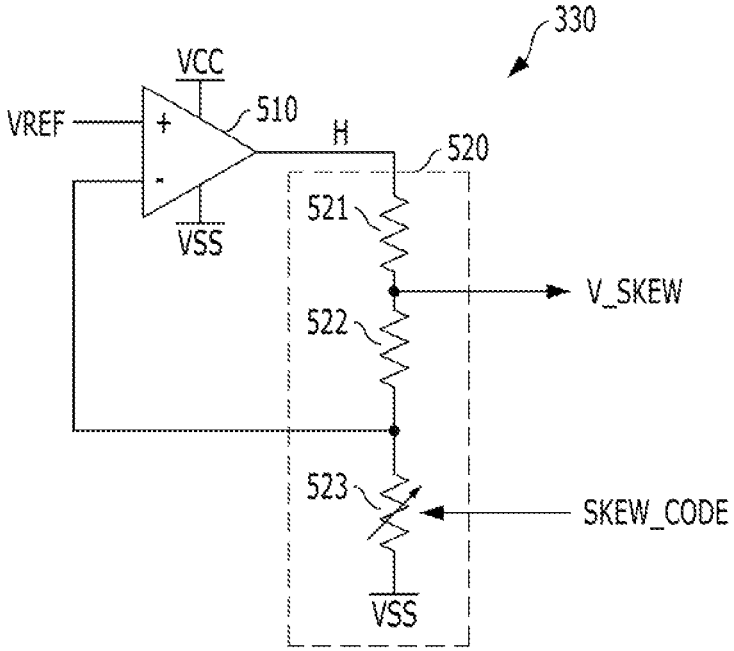
FIG. 5 is a configuration diagram illustrating a second voltage generation unit shown in FIG. 3.

FIG. 5 is a detailed diagram illustrating the second voltage generation unit 330 shown in FIG.

Referring to FIG. 5, the second voltage generation unit 330 includes an operational amplifier 510 and a voltage division section 520.

The operational amplifier 510 is configured to receive the reference voltage VREF and a feedback voltage F3. When the level of the reference voltage VREF is higher than that of the feedback voltage F3, a voltage level of an output node H of the operational amplifier 510 is high. When the level of the feedback voltage F3 is higher than that of the reference voltage VREF, the voltage level of the output node H of the operational amplifier 510 is low.

The voltage division section 520 is configured to divide the voltage of the output node H of the operational amplifier 510 using resistors 521 to 523, and to generate the second voltage V_SKEW and the feedback voltage F3. Among the resistors 521 to 523, a resistance of the resistor 523 may be adjusted based on the process skew information SKEW_CODE.

The second voltage generation unit 330 having the aforementioned configuration generates the second voltage V_SKEW having a level that is determined based on the level of the reference voltage VREF and the process skew information SKEW_CODE.

Figure 6:
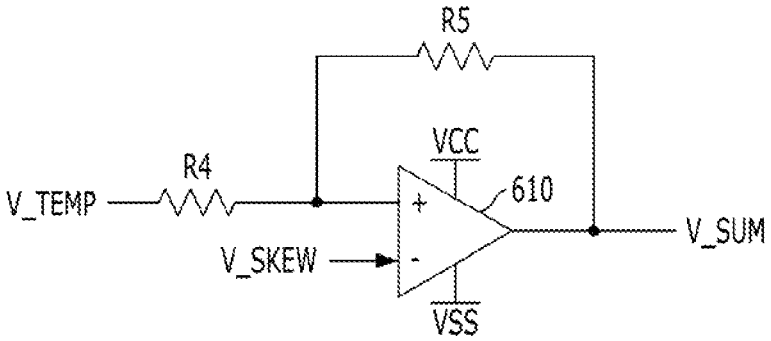
FIG. 6 is a configuration diagram illustrating an adding unit shown in FIG. 3.

FIG. 6 is a detailed diagram illustrating the adding unit 40 shown in FIG. 3.

Referring to FIG. 6, the adding unit 340 includes an operational amplifier 610 and resistors R4 and R5.

Base on the virtual short and virtual open principle, since (V_SKEW−V_TEMP)/R4+(V_SKEW−V_SUM)/R5=0, the third voltage V_SUM=(R5/R4)*(V_SKEW−V_TEMP)+V_SKEW. That is, the third voltage V_SUM is obtained by linearly adding the first voltage V_TEMP and the second voltage V_SKEW.

Figure 7:
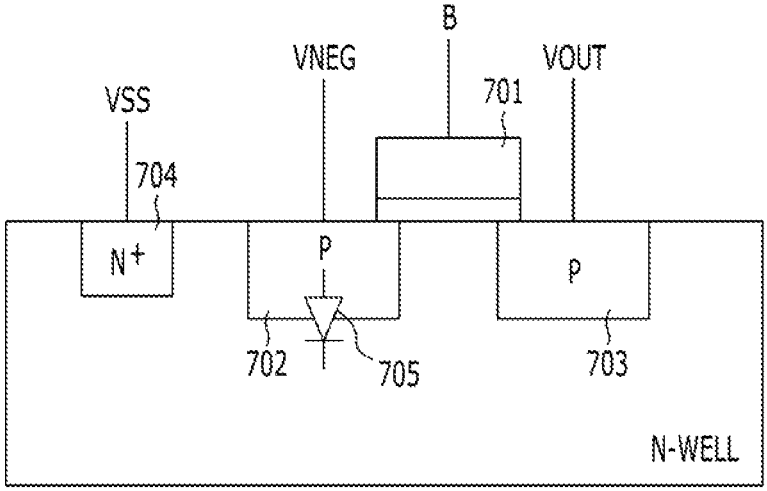
FIG. 7 is a cross-sectional view illustrating a pull-down element shown in FIG. 2.

FIG. 7 is a cross-sectional view illustrating the pull-down element P2 shown in FIG. 2.

Referring to FIG. 7, a P+ drain region 702, a P+ source region 703, a gate electrode 701, and an N+ pick-up region 704 are formed on an N-well (or N-substrate). A parasitic diode 705 is formed in the substrate. The ground voltage VSS is supplied to the body of the PMOS transistor (i.e., the pull-down element P2) through the N+ pick-up region 704. Thus, a current leakage caused by the turned-on parasitic diode 705 may be substantially reduced.

While the present invention has been described with respect to the specific embodiments, it should be noted that the embodiments are for describing, not limiting, the present invention. Further, it should be noted that the present invention may be achieved in various ways through substitution, change, and modification, by those skilled in the art without departing from the scope of the present invention as defined in the following claims.

What is claimed is:

1. A voltage generation circuit comprising:

a negative voltage generation unit configured to generate a negative voltage;

a first voltage generation unit configured to generate a first positive voltage having first correction information;

a second voltage generation unit configured to generate a second positive voltage having second correction information;

an addition unit configured to add the first positive voltage and the second positive voltage to generate a third positive voltage; and a negative voltage regulation unit configured to regulate the negative voltage based on the third positive voltage and regulation target information, and to generate a final negative voltage;

wherein the first correction information is used to correct the output voltage based on a temperature variation, and the second correction information is used to correct the output voltage based on a process skew variation.

2. The voltage generation circuit of claim 1, wherein the first voltage generation unit comprises:

a first operational amplifier configured to receive a control voltage regulated by a reference voltage and a first feedback voltage; and a first voltage division section configured to divide an output voltage of the first operational amplifier to generate the first feedback voltage and the first voltage with a voltage division ratio of the first voltage division section that is regulated by the first correction information.

3. The voltage generation circuit of claim 2, wherein the second voltage generation unit comprises:

a second operational amplifier configured to receive the reference voltage and a second feedback voltage; and a second voltage division section configured to divide an output voltage of the second operational amplifier to generate the second feedback voltage and the second voltage with a voltage division ratio of the second positive voltage division section that is regulated by the second correction information.

4. The voltage generation circuit of claim 3, wherein the addition unit comprises:

a third operational amplifier configured to output the third voltage;

a first resistor coupled between a first input terminal of the third operational amplifier and an output terminal of the first voltage generation unit; and a second resistor coupled between the first input terminal and an output terminal of the third operational amplifier.

5. The voltage generation circuit of claim 1, wherein the negative voltage regulation unit comprises:

an operational amplifier configured to receive a feedback voltage and the third positive voltage;

a pull-up element configured to pull-up drive a first node based on output voltage of the operational amplifier;

a load element coupled between the first node and a negative voltage terminal from which the negative voltage is generated;

a pull-down element configured to pull-down drive the final negative voltage output terminal, from which the final negative voltage is outputted, using the negative voltage based on a voltage level of the first node; and a voltage division unit coupled between the negative voltage output terminal and a pull-up voltage terminal, and configured to generate the feedback voltage by voltage division.

6. The voltage generation circuit of claim 5, wherein the feedback voltage is a positive voltage.

7. The voltage generation circuit of claim 6, wherein the pull-up element includes a first PMOS transistor and the pull-down element includes a second PMOS transistor.

8. The voltage generation circuit of claim 7, wherein a power supply voltage is supplied to a body of the first PMOS transistor, and a ground voltage is supplied to a body of the second PMOS transistor.

9. The voltage generation circuit of claim 1, wherein the voltage division unit comprises:

two or more resistors serially connected to each other between the negative voltage output terminal and the pull-up voltage terminal, wherein a resistance of one of the resistors is adjusted based on the regulation target information.

* * * * *